United States Patent [19]

Buschmann

[11] Patent Number: 5,003,217

[45] Date of Patent: Mar. 26, 1991

[54] FLOATING RIVET PIN LAMP BASE

[75] Inventor: Jeffrey P. Buschmann, Lexington, Ky.

[73] Assignee: GTE Products Corporation, Del.

[21] Appl. No.: 451,848

[22] Filed: Dec. 18, 1989

[51] Int. Cl.[5] ..... H01J 5/50

[52] U.S. Cl. ..... 313/318; 313/580; 439/611; 439/617

[58] Field of Search ..... 313/318, 580; 439/611, 439/618, 617

[56] References Cited

U.S. PATENT DOCUMENTS

| | | | |
|---|---|---|---|
| 2,252,476 | 11/1940 | Wright | 313/113 |
| 2,644,100 | 12/1945 | Brunsdorf | 313/115 |
| 4,864,184 | 9/1989 | Fleming | 313/318 |

*Primary Examiner*—Donald J. Yusko
*Assistant Examiner*—N. D. Patel
*Attorney, Agent, or Firm*—William E. Meyer

[57] ABSTRACT

A lamp base having a floating rivet pin is described. Due to mechanical stress, sealed beam reflector leads may need mechanical strengthening; however, heat stress may be transmitted through the strengthening means. A rivet pin may be coupled in the lamp base having one face abutting the base, a shaft portion closely, but slideably positioned in a passage and a second face offset from the base. During thermal expansion of the lead, the second pin face may approach abutment with the base without stressing the seal structures. The floating rivet pin, secured by being snugly fit radially in the base passage to hold the floating pin, then resists the twisting that may occur during mounting.

16 Claims, 3 Drawing Sheets

FLOATING RIVET PIN LAMP BASE

1. TECHNICAL FIELD

The invention relates to electric lamps and particularly to electric lamps with pin type connectors. More particularly the invention is concerned with a base for a high wattage electric lamp with a pin type connector.

2. BACKGROUND ART

Lamps are commonly supported, either in part or wholly, by the lamp leads and in particular, by a pin structure coupled to the leads. The mechanical stress put on the leads by repeated coupling and uncoupling the lamp can break down the lead seals, causing the lamp to fail. The mechanical stress on the leads may be particularly excessive in expensive lamps that are either rented, or otherwise moved from location to location for short term use. Studio lamps are an example of lights that are frequently moved, and are subjected to lead stress. The frequent coupling and uncoupling of the lamp leads can then result in premature lamp failure. One method to resist the lead stress is to form an insulating bridge between the leads. Unfortunately, for high wattage lamps, the leads become hot during service causing thermal stress between the leads and bridge. Disproportionate thermal expansion in the mechanical protection can cause thermal destruction of the lamp seal. There is then a need for a structure to strengthen the lamp leads and in particular the lamp leads of high wattage, pin base lamps, without weakening the existing seals, or transmitting thermal stress.

An examples of the prior art is shown in U.S. Pat. No. 2,252,476. U.S. Pat. No. 2,252,476 Wright shows a sealed beam lamp with a cap structure enclosing the seals and coupling the distal ends of the lamp leads. The cap provides a thermal expansion joint between the cap and reflector back.

DISCLOSURE OF THE INVENTION

An electric lamp may be formed with a sealed lamp having a light source positioned in a cavity defined by an envelope, and at least two leads for the light source passing through the envelope and emerging from the envelope, a base coupled to the envelope. Each base passage has for each respective lead, a base passage having an internal diameter, with a respective lamp lead positioned to pass slidingly therethrough, a first base face adjacent the base passage facing away from the sealed lamp, and a second base face adjacent the base passage facing the sealed lamp. Lead pins are positioned in the base passages with a lead pin for each respective lamp lead, each respective lead pin having a pin passage with a respective lamp lead positioned to pass therein, an external pin portion having a first pin face abutting the first base face in a first thermal state, and an internal portion having a second pin face offset from the second base face in the first thermal state to no more than abut the second base face in a second thermal state.

BEST MODE FOR CARRYING OUT THE INVENTION

Figure 1:
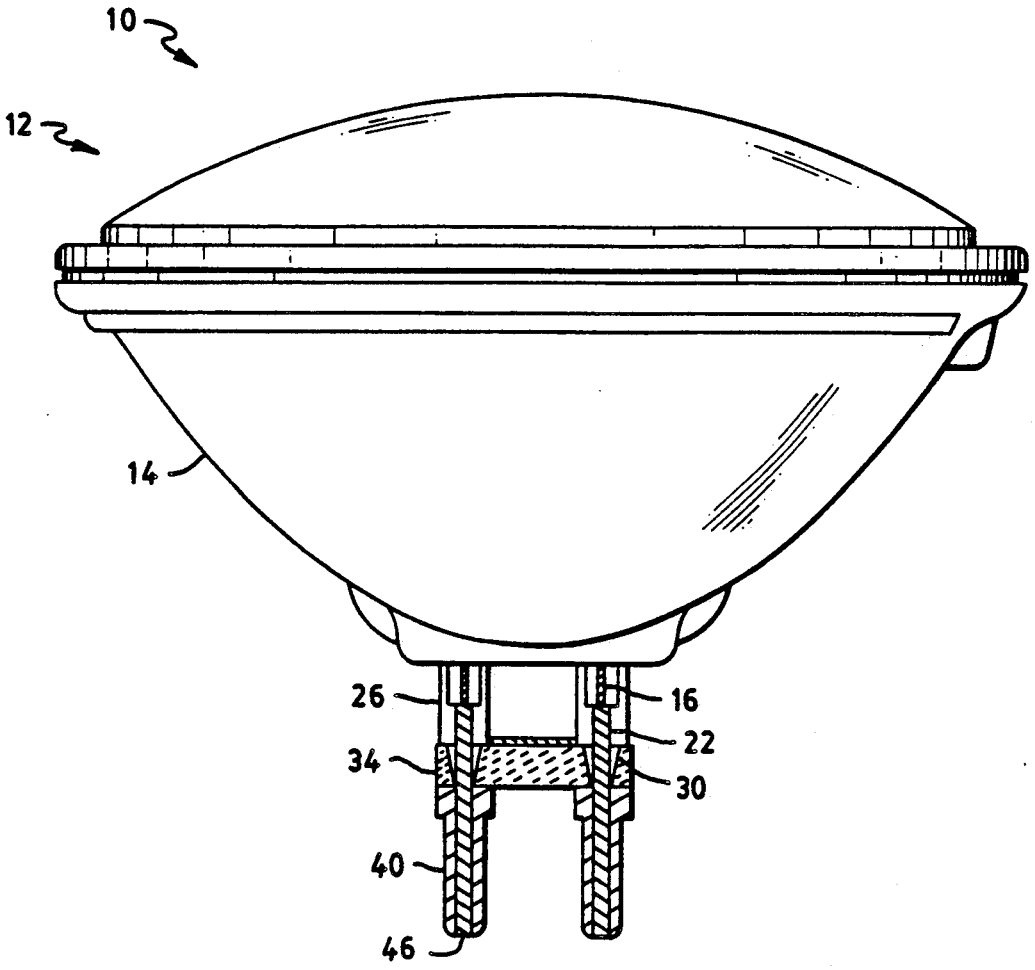
FIG. 1 shows a preferred embodiment of a sealed beam reflector lamp with the pin type base in cross section.
Figure 2:
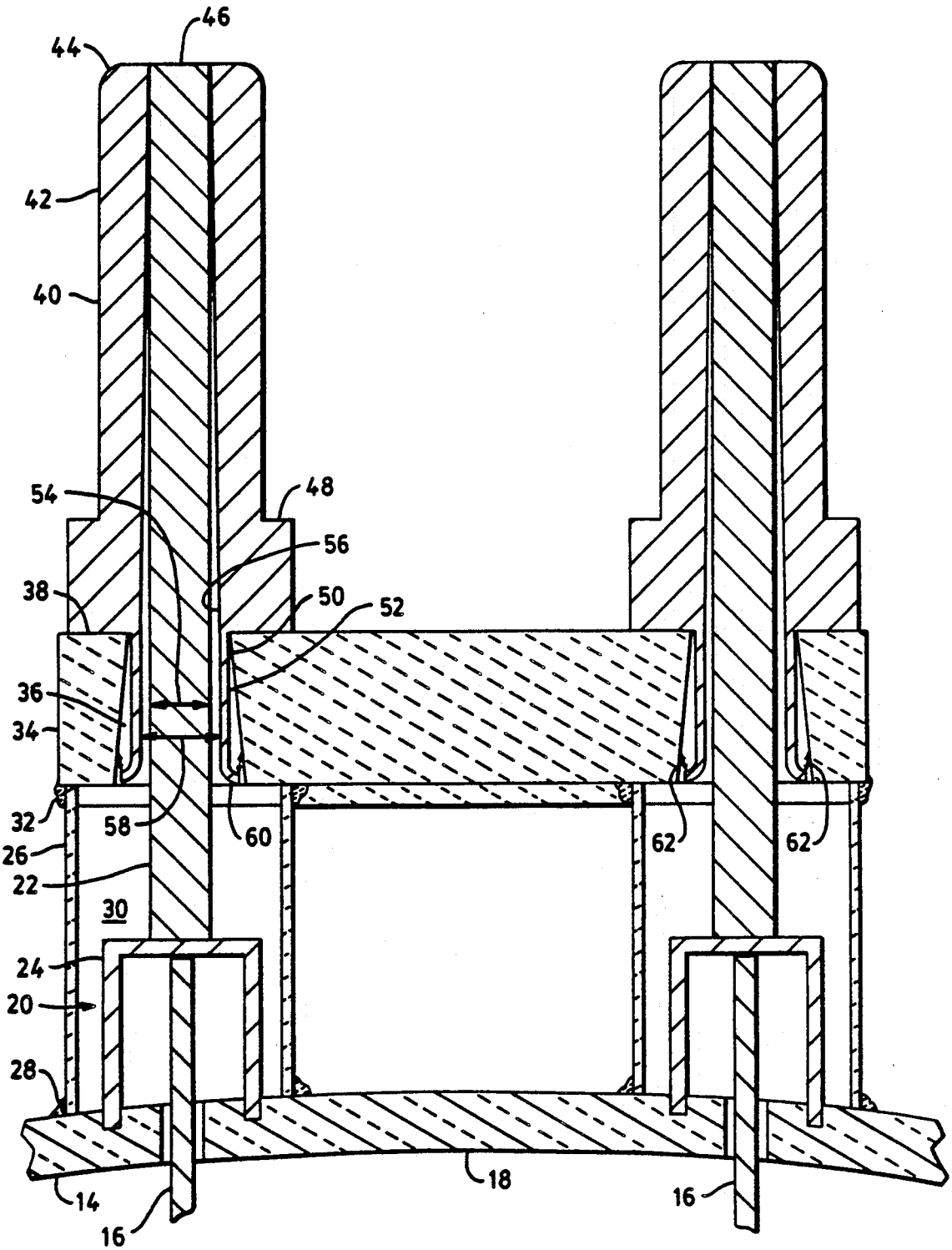
FIG. 2 shows a cross sectional view of the lamp base in FIG. 1 with the reflector partially broken away.

FIG. 1 shows a preferred embodiment of a sealed beam reflector lamp with the base shown in cross section. The reflector lamp 10 has an enclosed light source 12, a reflector 14, and at least two leads emerging from the reflector 14. By way of example reflector lamp 10 is shown as a sealed beam reflector lamp 10 typical of those used in studio lighting. The lamp may have a base assembled from two collars, a lead bridge and two floating rivet lead pins. FIG. 2 shows a cross sectional view of the lamp base with the reflector partially broken away. Other suitable lamp types, and other cross section configurations may use the present floating rivet design, such as high wattage pin connector lamps.

The reflector lamp 10 contains a light source 12, partially enclosed by a reflector 14, and powered by at least two inner leads 16. The inner leads 16 pass through the reflector back 18 by way of seal structures 20 to couple with or become two outer leads 22 on the exterior of the lamp. The reflector back 18 is commonly an arched, heavy body glass that is capable of withstanding mechanical stress. The particular seal structure 20 is not felt to be significant with respect to the present design, other than that temperature changes during lamp operation cause thermal expansion or contraction of the outer leads 22.

In the particular embodiment shown, ferrule type seals are used. Metal cups, called ferrules 24, are inverted placed over holes made through the reflector back 18. The glass reflector back 18 is heated adjacent the rims of the ferrules 24, and the ferrules 24 are meshed with the molten glass to form a seal. The inner leads 16 are then brazed to the insides of the ferrules 24 to make an electrical connection. Outer leads 22 are then silver soldered to the opposite, exterior sides of the ferrules 24 to continue the electrical connection. The outer leads 22 then project from proximal ends, away from the reflector back 18 in an axial direction to distal ends 46.

In the preferred embodiment, the base comprises two collars 26, and coupled between the two collars 26 is a bridge 34. The reflector back 18 is couple to the collar 26 along a first face 28. In the preferred embodiment, the reflector back 18 is cemented to the collars 26 along the first face 28. The collars 26 may be cylindrical pieces having central passages 30. The preferred collars 26 are made of a ceramic material capable of withstanding moderately high temperatures, while electrically insulating the outer leads 22. It is a further useful feature that the collars 26 be sufficiently strong to resist bending, twisting, compression, chipping and other mechanical stresses. The central passage 30 is formed to fit over the seal structure 20, and in the seal shown, the central passage 30 is formed to fit over the ferrules 24. The collars 26 then rest against the reflector back 18 and not on the seal structure 20. The outer leads 22 pass through the central passages 30. The collars 26, on an end opposite the first face 28 have a second face 32. Abutting the collars 26 along the second faces 32 is the bridge 34. In the preferred embodiment, the collars 26 and bridge 34 are formed to fit together in a complementary fashion, and are then cemented together to form a strong coupling. Other mechanical couplings between the collars 26 and bridge 34 may be used. The collar and bridge structure may also be formed as a solid piece.

The bridge 34 includes at least two bridge passages 36 appropriately separated so the outer leads 22 emerging from the central passages 30 of the respective collars 26 may be threaded through the bridge passages 36. The bridge 34 may then be positioned adjacent two, or more collars 26, with the respective outer leads 22 emerging through the central passages 30 and passing through the associated bridge passages 36. The preferred bridge passages 36 are shaped to receive and coact with the floating rivet pins. In the preferred embodiment, the bridge passages 36 are conically shaped, with the base of the cone facing the collars 26, and the narrow end of the cone facing away from the lamp. The conical shape is easily molded, and allows for an even circumferential contact with a rivet pin 40. The conical shape is also felt to provide a controlled positioning and less abrupt contact for the inner pin portion. The conical shape provides a narrowing of the bridge passage 36 in the direction away from the light source. Similar alternative narrowings whether straight, curved, or stepped, as either a shoulder, lip, ridge, or protuberance may be used. On the distal side of the bridge 34, near where the outer leads 22 emerge from the bridge passage 36, there is formed a face, lip or exterior wall 38 providing an axial stop adjacent the outer leads 22. In a similar fashion, the preferred bridge 34 is made of a ceramic material capable of withstanding moderately high temperatures, while electrically insulating the outer leads 22. It is a further useful feature that the bridge 34 be sufficiently strong to resist bending, twisting, compression, chipping and other mechanical stresses.

Coupled to the bridge 34 are two or more floating rivet pins 40. The preferred pins 40 have exterior tubular sections 42, with a rolled edge 44 of the distal end. The rolled edge 44 may be coupled to the distal ends 46 of the outer leads 22, for example by TIG welding. The exterior tubular sections 42 extend around the outer leads 22 as a sheath back towards the bridge 34, where a shoulder 48, or similar means for blocking axial motion is formed to abut the exterior face 38 of the bridge 34. The pin diameter then narrows to fit the narrowed portion 50 of the bridge passage 36. The pin continues with an internal pin section 52 having an inner diameter 54 at a pin neck 56 sufficient to let the outer lead 22 pass through the pin 40, and an outer diameter 58 sufficient to let the pin pass into the bridge passage 36. With the dimension of the narrowed portion 50 of the bridge passage 36 close to the outer diameter 58 of the inner pin section 52, there is little or no effective transaxial motion of the outer leads 22 or pins 40 in the bridge passages 36. The proximal pin end 60 of the pin is positioned closer to the light source than is the narrowed bridge portion 50. The proximal pin end 60 of the pin is knurled, peened, spread or otherwise mechanically reshaped to more closely fit the inner surface of the bridge passage 36. The preferred reshaping is to spread the proximal pin end 60 by reaming, so the proximal pin end 60 and bridge passage 36 are within a close axial gap 62 tolerance of each other.

The close gap 62 tolerance to be achieve is related to the choice of materials selected for the outer leads 22, the collars 26, the bridge 34 and the pins 40. The close tolerance to be achieve is further dependent on the geometry of the bridge passage 36 and the proximal pin ends 60. Understanding the operation of the floating rivet pin 40 makes the interrelation clear. When the lamp base structure is cool, the outer leads 22, collars 26, bridge 34, and pins 40 are in a thermally contracted state. Since, the metal leads 22 and pins 40 have greater expansions than the ceramic collars 26 and bridge 34, the outer leads 22 and pins 40 are designed so the pin shoulder 48 abuts the bridge 34 exterior face 38 in the cold state. Forces on the exterior pins 40 ends are then transmitted through the pin shoulder 48, and pin neck 56 to the bridge 34, and thereafter the collars 26 and reflector back 18. With the dimension of the bridge passage narrowed portion 50 close to the outer diameter 58 of the internal pin section 52, there is little or no effective transaxial motion of the leads 22 or pins 40. In combination, with the reflector back 18 coupled to the collars 26, and the collars 26 coupled to the bridge 34, the forces placed on the outer leads 22 or pins 40 are substantially transmitted to the reflector back 18, collars 26 and bridge 34, and not to the seal structure 20. There is then little or no mechanical stress placed on the seal structure 20.

When the lamp is turned on, and heats up, the metal outer leads 22 and pins 40 may expand. The outer leads 22 tend to push or slide out through the bridge passage 36, until the spread rivet pin end 60 closes the close tolerance gap 62 and engages the bridge passage 36. The amount of the expansion gap 62 allowed by the floating rivet pins 40 should approximately equal or greater than the difference in the linear axial expansions between the collar 26, and the seal structure 20, and outer lead 22 up to the point where the internal pin end 60 contacts the narrowed bridge passage 36. The expansion of the internal pin section 52 up to the pin shoulder 48, and the expansion of the outer lead 22 through the same axial distance are felt to be approximately equal. It is important that the proximal pin end 60 either not contact the bridge during thermal expansion, or that there be some flexibility in the seal structures 20. If the pin 40 were rigidly fixed to the bridge 34, in either a cold or hot state, the thermal forces of expansion or contraction would be transmitted back to the seal structure 20 stressing the rigid seal.

Figure 3:
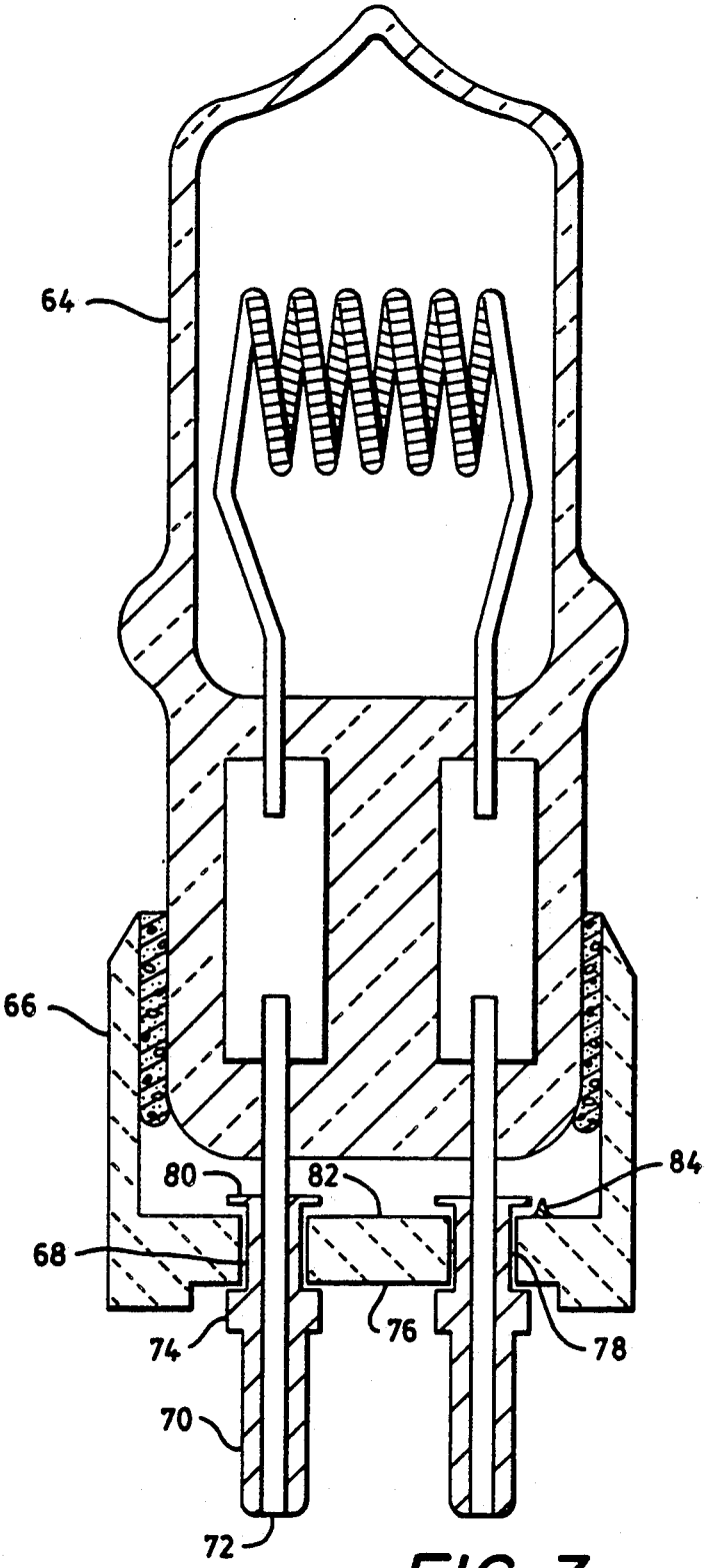
FIG. 3 shows an alternative embodiment of a lamp, and lamp base in cross section.

FIG. 3 shows an alternative embodiment of a lamp, and lamp base The preferred use for the floating rivet structure is in the strengthened pin type lamp of FIG. 1, but the design is nonetheless generally applicable to other pin type lamps. FIG. 3 shows a lamp capsule 64 cemented in a boxy ceramic base 66. The base 66 includes narrowed base passages 68 having straight, cylindrical walls sized to receive the pins 70. Two lamp leads 72 project from the lamp capsule 64 into the base passages 68. Two floating rivet pins 70 are mounted in the ceramic base 66 to sheath the lamp leads 72. Each pin 70 has a first shoulder 74 abutting an outer facing surface 76 of the base 66, a narrowed neck section 78 closely fitting, at least a portion of the inside surface of the base passage 68, and a second shoulder 80. The second shoulder 80 is offset from an inner facing surface 82 of the base 66 by a distance 84 greater than or equal to the relative thermal expansion distance of the lead 72 with respect to the base 66. The pin 70, in the preferred embodiment, is then restricted in a cold state as to inward, that is lamp directed, motion by the first shoulder 74 and outer facing surface 76. The pin 70, in the preferred embodiment, is restricted as to or transaxial motion by the base passage 68 and the closely fitted neck portion 78. The leads, and pin are is not restricted, within the range of thermal extension, as to thermal extension through the base in a hot state.

In a working example some of the dimensions were approximately as follows: The cylindrical collar was formed from steatite with an inside diameter of 1.270 cm (0.500 inch) and an outside diameter of 1.778 cm (0.700 inch). The collar was 2.021 cm (0.796 inch) long with parallel notches cut at one end to an axial depth of 0.228 cm (0.090 inch), and a radial depth of 0.368 cm (0.145 inch), leaving keyed sections to fit into and lock with a 1.109 cm (0.437 inch) wide notch formed lengthwise in the bridge. The outer leads were 0.474 cm (0.187 inch) diameter copper extending, along with ferrule type seals, about 6.35 cm (2.500 inch) from the reflector back. The floating rivet pins were solid brass with an overall length of 4.445 cm (1.75 inch). The shoulder had an axial length of 0.714 cm (0.281 inch), and a diameter of 1.587 cm (0.625 inch). The pin had a tubular exterior end with an axial length of 2.857 cm (1.125 inch), and a diameter of 1.109 cm (0.437 inch). The overall exterior length of the pin was 3.492 cm (1.375 inch). The interior section of the pin had an inner diameter of 0.555 cm (0.218 inch), and an outer diameter of 0.635 cm (0.250 inch). After inserting the pin in the bridge passage, the proximal end of the pin was curled out in the form of a rivet to form a lip edge with a diameter of about 0.9 cm (0.035 inch). The bridge was made of steatite in the general form of a block that was 0.952 cm (0.375 inch) thick, 3.175 cm (1.250 inch) wide, and 5.397 cm (2.125 inch) long. The bridge had two conical internal passages. The base diameter of each internal passage was 0.952 cm (0.375 inch), and the narrowest diameter was 0.680 cm (0.268 inch). The bridge had a rectangular groove on the side facing the reflector back that was 0.158 cm (0.062 inch) deep, 1.111 cm (0.437 inch) wide, and 5.397 cm (2.125 inch) long. The bridge had a rectangular passage formed parallel with and between the lead passages for ventilation. In the above working example, the pins were solidly positioned in the cool state, permitting repeated bolting into place, and subsequent removal without damage to the lamp leads, or bridge structure. The lamp seals were not adversely worn by the thermal stresses of repeated temperature cycling. The disclosed dimensions, configurations and embodiments are as examples only, and other suitable configurations and relations may be used to implement the invention.

While there have been shown and described what are at present considered to be the preferred embodiments of the invention, it will be apparent to those skilled in the art that various changes and modifications can be made herein without departing from the scope of the invention defined by the appended claims.

What is claimed is:

1. An electric lamp comprising:

(a) a sealed lamp having a light source positioned in a cavity defined by an envelope, and at least two leads for the light source passing through the envelope and emerging from the envelope, (b) a base coupled to the envelope, having for each respective lead a base passage having an internal diameter, with a respective lamp lead positioned to pass slidingly therethrough, a first base face adjacent the base passage facing away from the sealed lamp, and a second base face adjacent the base passage facing the sealed lamp, and (c) a lead pin for each respective lamp lead, each respective lead pin having a pin passage with a respective lamp lead positioned to pass therein, an external pin portion having a first pin face abutting the first base face in a thermally cool state, and an internal pin portion positioned in a respective base passage.

2. An electric lamp comprising:

(a) a sealed lamp having a light source positioned in a cavity defined by an envelope, and at least two leads for the light source passing through the envelope and emerging from the envelope, (b) a base coupled to the envelope, having a respective collar for each of the at least two of the leads, each respective collar having a central passage, with a respective lamp lead positioned to pass slidingly therethrough, a first collar face coupled to the reflector back, and a second collar face positioned on the opposite side of the collar from the first collar face, (c) a lead bridge coupled to the respective second collar faces of at least two collars, having for each collar a respective bridge passage, coterminous with the respective collar passage with a respective lamp lead positioned to pass slidingly therethrough, and (d) a lead pin for at least two of the respective lamp leads, each respective lead pin having a central passage with a respective lamp lead positioned to pass therethrough, each of the lamp leads being mechanically coupled to the respective lead pin, and each lead pin being butted to the bridge to prohibit movement of the pin towards the reflector back in a cold state, and free to extend away from the reflector back in a hot state.

3. The apparatus in claim 1, wherein at least one of the lead pins has an internal portion having a second pin face offset from the second base face to no more than abut the second base face in a hot state.

4. The apparatus in claim 1, wherein the internal pin portion includes a section closely fitted to the adjacent base passage to allow sliding interaction between the internal pin portion with respect to the base, while substantially prohibiting transaxial motion of the internal pin portion with respect to the base.

5. The apparatus in claim 1, wherein the base passage is conically shaped.

6. The apparatus in claim 1, wherein the base passage is cylindrically shaped.

7. The apparatus in claim 1, wherein the internal pin portion has an end closest to the lamp envelope with a diameter greater than the narrowest diameter of the base passage.

8. The apparatus in claim 7, wherein the end of the internal pin portion with the greater diameter has a conical shape.

9. The apparatus in claim 7, wherein the end of the internal pin portion with the greater diameter has a planar face transverse to an axis formed by the lamp lead.

10. The apparatus in claim 1, wherein the base passages have diameters sufficiently larger than the respective lead diameters at the lamp operating temperature to allow the leads to slide axially in the base passages at the lamp operating temperature.

11. The apparatus in claim 1, wherein the lamp leads are coupled to the ends of the pins farthest from the lamp envelope.

12. The apparatus in claim 2, wherein the collars are cemented to the reflector back.

13. The apparatus in claim 2, wherein the collars are cemented to the base.

14. The apparatus in claim 2, wherein the bridge includes a complementary formed portion to couple with the collars to assist in positioning and holding the collars.

15. The apparatus in claim 1, wherein the cool state is the bridge temperature state when the lamp is in an off state.

16. The apparatus in claim 3, wherein the hot state is the bridge temperature state when the lamp is in an on state.

* * * * *